United States Patent [19]

Martin

[11] 4,425,198

[45] Jan. 10, 1984

[54] BRIGHTENING COMPOSITION FOR ZINC ALLOY ELECTROPLATING BATH AND ITS METHOD OF USE

[75] Inventor: Sylvia Martin, Detroit, Mich.

[73] Assignee: OMI International Corporation, Warren, Mich.

[21] Appl. No.: 274,085

[22] Filed: Jun. 16, 1981

[51] Int. Cl.[3] ..... C25D 3/56

[52] U.S. Cl. ..... 204/43 Z

[58] Field of Search ..... 204/43 Z, 55 R, 114, 204/123

[56] References Cited

U.S. PATENT DOCUMENTS

| | | | |
|---|---|---|---|
| 3,723,262 | 3/1973 | Rushmere | 204/55 R |
| 4,176,017 | 11/1979 | Martin | 204/55 R |
| 4,226,682 | 10/1980 | Popescu | 204/55 R |
| 4,229,267 | 10/1980 | Steinecker | 204/55 R |

FOREIGN PATENT DOCUMENTS

| | | | |
|---|---|---|---|
| 759424 | 5/1967 | Canada | 204/55 R |
| 56-293 | 1/1981 | Japan | 204/43 Z |
| 394460 | 8/1973 | U.S.S.R. | 204/55 R |
| 508565 | 3/1976 | U.S.S.R. | 204/43 Z |

*Primary Examiner*—G. L. Kaplan

*Attorney, Agent, or Firm*—Richard P. Mueller

[57] ABSTRACT

An acid zinc alloy electroplating bath such as a zinc-nickel and/or cobalt bath and process employing said bath which contains an effective amount of a brightening agent selected from a bath soluble polyacrylamide polymer, N-substituted polyacrylamide derivative, and copolymers thereof. The zinc alloy electroplating is economical and versatile in use and produces a ductile, corrosion resistant plating deposit having a semi-bright to bright appearance.

7 Claims, No Drawings

BRIGHTENING COMPOSITION FOR ZINC ALLOY ELECTROPLATING BATH AND ITS METHOD OF USE

BACKGROUND OF THE INVENTION

The present invention relates to an acid zinc alloy electroplating bath and the process of electroplating a zinc alloy onto a conductive substrate using the bath. The acid zinc alloy electroplating bath and process of the present invention is particularly applicable to so-called high speed electroplating operations over a wide current density range such as are encountered in strip plating, wire plating, rod plating, conduit plating, or the like.

Electro-deposited zinc alloy of a semi-bright to a lustrous appearance is desirable to provide a decorative plating appearance while simultaneously imparting excellent corrosion protection. The alloy is deposited on a conductive substrate by means of a zinc alloy electroplating bath, such as a zinc-nickel, zinc-cobalt, or zinc-nickel-cobalt bath, which incorporates brightening agents in amounts effective to provide a ductile, corrosion resistant zinc alloy deposit having a semi-bright to bright appearance.

It will be appreciated by those skilled in the art that zinc alloy baths and processes, for example, white and yellow brass alloys and processes, are not analogous to acid zinc baths and processes. For example, brightening agents which are effective for zinc plating are often not effective for alloys of zinc. Thus, some zinc brighteners and other agents have a harmful influence on zinc alloys causing zinc alloy deposits which are sooty black, non-ductile, or poorly adhering. Some zinc brighteners or agents cause high current density burning, prevent co-deposition of the alloying metal in sufficient quantities, or provide no brightening effect in the zinc alloy processes. Therefore, it will be further appreciated by those skilled in the art that the bath and electroplating process of the present invention particularly relates to the zinc alloy, rather than zinc, baths and processes.

SUMMARY OF THE INVENTION

In accordance with the present invention, a zinc alloy electroplating bath incorporates zinc and nickel and/or cobalt ions and a brightening agent selected from the group consisting of a homo polymer of acrylamide, a homo polymer of an N-substituted acrylamide, a copolymer of an acrylamide and an N-substituted acrylamide and/or a solubilizing agent selected from the group consisting of methacrylic acid, acrylic acid, acrylonitrile, methacrylonitrile, vinyl $C_1$–$C_5$ alkyl esters, vinyl halide, epihalohydrin, vinylidine halide, alkylene oxide and mixtures thereof. The process of the present invention involves electrodepositing a zinc alloy from the foregoing acid or neutral zinc alloy electroplating bath onto a conductive substrate.

Further understanding of the present invention will be had from a reading of the description of the preferred embodiments taken in conjunction with the specific examples provided. All parts and percentages used herein are on a weight basis unless otherwise specifically stated.

DESCRIPTION OF THE PREFERRED EMBODIMENTS

The improved zinc alloy electroplating bath of the present invention comprises an aqueous solution containing a hydrogen ion concentration sufficient to provide an operating pH of from about 0 up to about 6.5. The bath further comprises zinc ion, nickel and/or cobalt ion, and a polyacrylamide brightening agent. In addition, the bath can further incorporate appropriate concentrations of other constituents conventionally utilized in acid zinc alloy electroplating baths, such as metal salts, conductivity salts, buffering agents, and supplemental brightener constituents of the types heretofore known to further enhance the brightness of the zinc alloy plating deposits obtained.

The zinc ion, in accordance with conventional practice, is introduced into the aqueous solution in the form of an aqueous soluble zinc salt, such as zinc sulfate, zinc chloride, zinc fluoroborate, zinc sulfamate, zinc acetate, or the like, in addition to mixtures thereof to provide an operating zinc ion concentration ranging from about 7.0 g/l to about 165 g/l with concentrations of about 20 g/l up to 100 g/l being preferred.

The nickel and cobalt ions, in accordance with conventional practice, are also introduced into the aqueous solution in the form of the aqueous soluble salt of nickel or cobalt such as the chloride, sulfate, fluoroborate, acetate, or sulfamate salts and the like, or mixtures thereof. Either or a combination of both nickel and cobalt ions can be used herein. To produce an alloy deposit containing about 0.1% to about 20% of each of nickel and/or cobalt, each should be employed in the bath in amounts of from about 1 g/l to about 60 g/l. Preferably, the alloy deposit contains from about 2% to about 10% of each nickel and/or cobalt, and the bath contains nickel and/or cobalt ion in an amount of from about 1 g/l to about 60 g/l respectively.

In addition to the foregoing electroplating bath constituents, the bath further includes as an essential ingredient, a controlled effective amount of a polymeric brightening agent which provides unexpected benefits in the zinc alloy deposit formed as well as in providing increased versatility in the use of the electroplating bath. The brightening agent comprises a polymer having the formula:

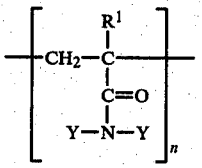

wherein:

Y may be the same or different and is R or RX, where R is H or $C_{1-10}$ aliphatic radical, where X is H, OH, $COOR^1$, $COON[R^1]_2$, $SO_3M$, CN, $N[R^1]_2$ or $OR^1$, where M is H or a Group I or II metal;

$R^1$ is H or $C_{1-4}$ alkyl radical; and n is 2 to 2,000,000; and copolymers of said polymer and a solubilizing agent present in an amount up to 25 mole percent of the copolymer selected from the group consisting of methacrylic acid, acrylic acid, acrylonitrile, methacrylonitrile, vinyl $C_{1-5}$ alkyl esters, vinyl halide, epihalohydrin, vinylidine halide, alkylene oxide and mixtures thereof.

The copolymerization of acrylamide or N-substituted acrylamide derivatives with the solubilizing agent provides for improved water solubility of the polymer and is desirable particularly when high molecular weight polymers are employed. The mole percent of the solubilizing agent in the resultant copolymer is controlled at an amount of less than about 25 mole percent to retain the beneficial character of the acrylamide constituent in providing improved brightening of the alloy deposit.

The concentration of the polymeric brightening agent may range from as low as about 0.001 g/l up to the solubility limit of the polymer in the aqueous bath. At concentrations below about 0.001 g/l optimum benefits of the polymeric brightener ordinarily cannot be obtained while concentrations above about 10 g/l usually result in the bath becoming undesirably viscous. The use of excessive amounts of the brightening agent obtains no appreciable benefit over that obtained with a more moderate concentration. Generally, the agent will be employed within a range of from about 0.1 to about 5 g/l, although the amount of polymeric brightening agent employed may vary depending upon the molecular weight of the specific polymer employed, the specific bath operating conditions, and/or the other constituents present in the bath such as the quantity and type of supplemental brighteners employed. Generally the higher the molecular weight of the polymer employed, the less quantity of polymer is necessary.

The acidity of the bath is preferably adjusted by employing an acid corresponding to the zinc salt used. Thus, depending upon the particular zinc salt in the bath, sulfuric acid, hydrochloric acid, fluoroboric acid, acetic acid, or the like, can be added to the bath to provide an operating pH of from about 0 up to about 6.5, preferably from about 2 up to about 5.5.

Conventionally, various conductivity salts and/or buffering agents or mixtures thereof are employed in electrodeposition baths. Such may also be used in a zinc alloy bath of the present invention. Thus, the bath can comprise sodium chloride and/or sulfate, potassium chloride and/or sulfate, ammonium chloride and/or sulfate, sodium, potassium or ammonium fluoroborate, sodium, potassium or ammonium sulfamate, magnesium sulfate, boric acid or its salts, acetic acid or its salts, or the like. These salts and/or agents are generally utilized in the bath in amounts ranging from 3 to 200 g/l.

It is also comtemplated that the bath of the present invention can further incorporate controlled amounts of other compatible brightening agents of the types conventionally employed in zinc alloy plating solutions. Included among such supplemental and optional brightening agents are aromatic aldehydes or ketones, nicotinate quaternaries, polyepichlorohydrin quaternaries with amines, polyethyleneimines and their derivatives, thioureas or N-substituted derivaties thereof, cyclic thioureas, $\alpha$-unsaturated carbonyl compounds, and the like.

In addition, aluminum ion can be introduced into the bath by an aqueous soluble salt thereof, such as aluminum sulfate, to obtain an enhanced brightening effect. Aluminum ion can suitably be employed in a concentration of from about 0.5 mg/l up to about 200 mg/l, preferably from about 4 mg/l up to about 40 mg/l.

To further enhance the corrosion resistance of the alloy deposit, small amounts of trace metals which will codeposit with the zinc alloy may be added to the electrolyte. For example, soluble salts of chromium, tin, or indium may be added to the bath in amounts of about 5 mg/l to about 4 g/l.

In accordance with the process of the present invention, the attainment of a semi-bright to lustrous zinc alloy plating deposit on a conductive substrate is achieved by employing the bath of the present invention in any one of a variety of known electroplating techniques to electrodeposit a zinc alloy onto the substrate. The bath is particularly applicable for high speed plating of articles such as wire, strip, tubing, or the like. In operation, the electroplating bath incorporating the constituents as heretofore described is controlled within an operating pH range of about 0 up to about 6.5 and at a temperature of from about 50° up to about 180° F. Zinc alloy plating can be carried out at current densities generally ranging from as low as about 10 amperes per square foot (ASF) up to 600 ASF and higher depending upon the specific plating technique employed.

In order to further illustrate the improved acid zinc alloy plating bath of the present invention, the following specific examples are provided.

EXAMPLE I

A steel conduit is plated at 175 ASF in a high speed cell with the bath solution strongly counterflowing with respect to the conduit. The plating bath has the pH of about 3.5 and is at room temperature. The bath is an aqueous solution comprising:

| ingredient | concentration |
|---|---|
| zinc sulfate ($ZnSO_4.H_2O$) | 100 g/l |
| nickel sulfate ($NiSO_4.6H_2O$) | 75 g/l |
| polyacrylamide (MW 19,000) | 1.5 g/l |

The appearance of the plated conduit is bright and uniform.

EXAMPLE II

A steel wire is plated at 250 ASF and a wire speed of 62 ft/min in a bath with good air agitation. The plating bath has a pH of about 4.0 and is at a temperature of about 85° F. The bath is an aqueous solution comprising:

| ingredient | concentration |
|---|---|
| zinc sulfate ($ZnSO_4.H_2O$) | 180 g/l |
| nickel sulfate ($NiSO_4.6H_2O$) | 50 g/l |
| aluminum sulfate ($Al_2(SO_4)_3.18H_2O$) | 0.2 g/l |
| poly 2-acrylamide-2-methyl propane sulfonic acid (MW 50,000) | 2 g/l |

The appearance of the plated wire is bright and uniform.

EXAMPLE III

A narrow, continuous steel strip moving at a speed of about 105 ft/min is plated at 300 ASF in a plating bath having a pH of about 3.0 and a temperature of about 90° F. The bath is an aqueous solution comprising:

| ingredient | concentration |
|---|---|
| zinc fluoroborate | 200 g/l |
| nickel fluoroborate | 50 g/l |
| polyacrylamide (MW 1,000,000) | 0.05 g/l |

The appearance of the plated strip is semi-bright and uniform.

EXAMPLE IV

A steel test panel is plated in a strongly air agitated bath for a period of ten minutes at a current density of 300 ASF. The plating bath has a pH of about 4.9 and is at room temperature. The bath is an aqueous solution comprising:

| ingredient | concentration |
|---|---|
| zinc sulfate ($ZnSO_4.H_2O$) | 80 g/l |
| nickel sulfate ($NiSO_4.6H_2O$) | 30 g/l |
| cobalt sulfate ($CoSO_4.6H_2O$) | 15 g/l |
| ammonium sulfate ($(NH_4)_2SO_4$) | 20 g/l |
| boric acid ($H_3BO_3$) | 38 g/l |
| polyacrylamide (MW 20,000) | 1.0 g/l |

The appearance of the plated test panel is bright.

EXAMPLE V

A steel strip moving continuously at 40 ft/min is plated at a current density of 60 ASF in a plating bath having a pH of 4.5 and a temperature of about 100° F. The plating bath is an aqueous solution comprising:

| ingredient | concentration |
|---|---|
| zinc chloride ($ZnCl_2$) | 110 g/l |
| nickel chloride ($NiCl_2.6H_2O$) | 95 g/l |
| polyacrylamide (MW 1,000) | 1.0 g/l |
| acetic acid | 2% |

The appearance of the plated steel strip is semi-bright and uniform.

EXAMPLE VI

A steel test panel is plated for a period of ten minutes at a current density of 80 ASF in a plating bath employing air agitation. The bath has a pH of about 4.2 and is at room temperature. The bath is an aqueous solution comprising:

| ingredient | concentration |
|---|---|
| zinc sulfate ($ZnSO_4.H_2O$) | 100 g/l |
| cobalt sulfate ($Co.SO_4.6H_2O$) | 50 g/l |
| boric acid ($H_3BO_3$) | 30 g/l |
| polyacrylamide (MW 400,000) | 0.25 g/l |

The appearance of the plated test panel is bright.

What is claimed is:

1. An aqueous zinc alloy electroplating bath having a pH of from about 0 up to about 6.5 and comprising about 7 to about 165 g/l zinc ions, at least one of nickel ions and cobalt ions individually present in an amount of about 1 to about 60 g/l, about 0.5 to about 200 mg/l aluminum ions, and an effective amount of a brightener comprising a bath soluble polymer of the formula:

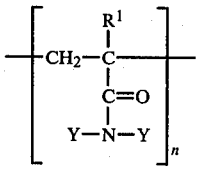

wherein:

Y may be the same or different and is R or RX, where R is H or $C_{1-10}$ aliphatic radical, where X is H, OH, $COOR^1$, $COON[R^1]_2$, $SO_3M$, CN, $N[R^1]_2$ or $OR^1$, where M is H or a Group I or II metal;

$R^1$ is H or $C_{1-4}$ alkyl radical; and n is 2 to 2,000,000; and copolymers of said polymer and a solubilizing agent present in an amount up to 25 mole percent of the copolymer selected from the group consisting of methacrylic acid, acrylic acid, acrylonitrile, methacrylonitrile, vinyl $C_{1-5}$ alkyl esters, vinyl halide, epihalohydrin, vinulidine halide, alkylene oxide and mixtures thereof.

2. The zinc alloy electroplating bath as defined in claim 1 in which said brightener is present in an amount of from about 0.001 g/l up to the solubility limit thereof in said aqueous zinc alloy electroplating bath.

3. The zinc alloy electroplating bath as defined in claim 1 in which said brightener is present in an amount of about 0.1 to about 5 g/l.

4. The zinc alloy electroplating bath as defined in claim 1 in which said aluminum ion is present in an amount of from about 4 mg/l up to about 40 mg/l.

5. The zinc alloy electroplating bath as defined in claim 1 comprising, in addition, from about 5 mg/l to about 4 g/l of a soluble salt of a metal selected from the group consisting of chromium, tin, indium and mixtures thereof.

6. The zinc alloy electroplating bath as defined in claim 1 wherein said bath comprises from about 20 g/l to about 100 g/l zinc ion.

7. A process for depositing a zinc alloy plate on a substrate which comprises the steps of electrodepositing zinc alloy from an aqueous zinc alloy electroplating bath of a composition as defined in any one of the claims 1–6.

* * * * *